US007402825B2

(12) United States Patent
Simmons et al.

(10) Patent No.: US 7,402,825 B2
(45) Date of Patent: Jul. 22, 2008

(54) LPP EUV DRIVE LASER INPUT SYSTEM

(75) Inventors: Rodney D. Simmons, San Diego, CA (US); John W. Viatella, San Diego, CA (US); Jerzy R. Hoffman, Escondido, CA (US); R. Kyle Webb, Escondido, CA (US); Alexander N. Bykanov, San Diego, CA (US); Oleh Khodykin, San Diego, CA (US)

(73) Assignee: Cymer, Inc., San Diego, CA (US)

( * ) Notice: Subject to any disclaimer, the term of this patent is extended or adjusted under 35 U.S.C. 154(b) by 567 days.

(21) Appl. No.: 11/168,785

(22) Filed: Jun. 28, 2005

(65) Prior Publication Data

US 2006/0289806 A1 Dec. 28, 2006

(51) Int. Cl.
*G21G 4/00* (2006.01)

(52) U.S. Cl. ..... 250/493.1; 250/504 R; 250/496.1; 250/503.1; 362/263; 362/266

(58) Field of Classification Search ..... 250/493.1, 250/496.1, 498.1, 503.1, 504 R, 461; 362/263, 362/266

See application file for complete search history.

(56) References Cited

U.S. PATENT DOCUMENTS

| | | | | |
|---|---|---|---|---|
| 2,759,106 | A | 8/1956 | Wolter | 250/53 |
| 3,150,483 | A | 9/1964 | Mayfield et al. | 60/35.5 |
| 3,232,046 | A | 2/1966 | Meyer | 50/35.5 |
| 3,279,176 | A | 10/1966 | Boden | 60/202 |
| 3,746,870 | A | 7/1973 | Demarest | 250/227 |
| 3,960,473 | A | 6/1976 | Harris | 425/467 |
| 3,961,197 | A | 6/1976 | Dawson | 250/493 |

(Continued)

FOREIGN PATENT DOCUMENTS

| | | | |
|---|---|---|---|
| JP | 2000091096 | A | 3/2000 |

OTHER PUBLICATIONS

Andreev et al., "Enhancement of laser/EUV conversion by shaped laser pulse interacting with Li-contained targets for EUV lithography," Proc. of SPIE, 5196:128-136 (2004).

(Continued)

*Primary Examiner*—Jack I. Berman
*Assistant Examiner*—Michael J Logie
(74) *Attorney, Agent, or Firm*—William C. Cray

(57) ABSTRACT

A laser produced plasma ("LPP") extreme ultraviolet ("EUV") light source and method of operating same is disclosed which may comprise an EUV plasma production chamber having a chamber wall; a drive laser entrance window in the chamber wall; a drive laser entrance enclosure intermediate the entrance window and a plasma initiation site within the chamber and comprising an entrance enclosure distal end opening; at least one aperture plate intermediate the distal opening and the entrance window comprising at least one drive laser passage aperture. The at least one aperture plate may comprise at least two aperture plates comprising a first aperture plate and a second aperture plate defining an aperture plate interim space. The at least one drive laser aperture passage may comprise at least two drive laser aperture passages. The laser passage aperture may define an opening large enough to let the drive laser beam pass without attenuation and small enough to substantially reduce debris passing through the laser passage aperture in the direction of the entrance window.

71 Claims, 3 Drawing Sheets

U.S. PATENT DOCUMENTS

| | | | | |
|---|---|---|---|---|
| 3,969,628 | A | 7/1976 | Roberts et al. | 250/402 |
| 4,042,848 | A | 8/1977 | Lee | 313/231.6 |
| 4,088,966 | A | 5/1978 | Samis | 313/231.5 |
| 4,143,275 | A | 3/1979 | Mallozzi et al. | 250/503 |
| 4,162,160 | A | 7/1979 | Witter | 75/246 |
| 4,203,393 | A | 5/1980 | Giardini | 123/30 |
| 4,364,342 | A | 12/1982 | Asik | 123/143 |
| 4,369,758 | A | 1/1983 | Endo | 123/620 |
| 4,504,964 | A | 3/1985 | Cartz et al. | 378/119 |
| 4,507,588 | A | 3/1985 | Asmussen et al. | 315/39 |
| 4,536,884 | A | 8/1985 | Weiss et al. | 378/119 |
| 4,538,291 | A | 8/1985 | Iwamatsu | 378/119 |
| 4,561,406 | A | 12/1985 | Ward | 123/536 |
| 4,596,030 | A | 6/1986 | Herziger et al. | 378/119 |
| 4,618,971 | A | 10/1986 | Weiss et al. | 378/34 |
| 4,626,193 | A | 12/1986 | Gann | 431/71 |
| 4,633,492 | A | 12/1986 | Weiss et al. | 378/119 |
| 4,635,282 | A | 1/1987 | Okada et al. | 378/34 |
| 4,751,723 | A | 6/1988 | Gupta et al. | 378/119 |
| 4,752,946 | A | 6/1988 | Gupta et al. | 378/119 |
| 4,774,914 | A | 10/1988 | Ward | 123/162 |
| 4,837,794 | A * | 6/1989 | Riordan et al. | 378/119 |
| 4,928,020 | A | 5/1990 | Birx et al. | 307/106 |
| 5,023,897 | A | 6/1991 | Neff et al. | 378/122 |
| 5,027,076 | A | 6/1991 | Horsley et al. | 324/674 |
| 5,102,776 | A | 4/1992 | Hammer et al. | 430/311 |
| 5,126,638 | A | 6/1992 | Dethlefsen | 315/326 |
| 5,142,166 | A | 8/1992 | Birx | 307/419 |
| 5,175,755 | A | 12/1992 | Kumakhov | 378/34 |
| 5,313,481 | A | 5/1994 | Cook et al. | 372/37 |
| 5,319,695 | A | 6/1994 | Itoh et al. | 378/84 |
| RE34,806 | E | 12/1994 | Cann | 427/446 |
| 5,411,224 | A | 5/1995 | Dearman et al. | 244/53 |
| 5,448,580 | A | 9/1995 | Birx et al. | 372/38 |
| 5,504,795 | A | 4/1996 | McGeoch | 378/119 |
| 5,729,562 | A | 3/1998 | Birx et al. | 372/38 |
| 5,763,930 | A | 6/1998 | Partlo | 250/504 |
| 5,866,871 | A | 2/1999 | Birx | 219/121 |
| 5,936,988 | A | 8/1999 | Partlo et al. | 372/38 |
| 5,963,616 | A | 10/1999 | Silfvast et al. | 378/122 |
| 5,970,076 | A | 10/1999 | Hamada | 372/20 |
| 6,031,241 | A | 2/2000 | Silfvast et al. | 250/504 |
| 6,031,598 | A | 2/2000 | Tichenor et al. | 355/67 |
| 6,039,850 | A | 3/2000 | Schulz | 204/192.15 |
| 6,051,841 | A | 4/2000 | Partlo | 250/504 |
| 6,064,072 | A | 5/2000 | Partlo et al. | 250/504 |
| 6,172,324 | B1 | 1/2001 | Birx | 219/121.57 |
| 6,195,272 | B1 | 2/2001 | Pascente | 363/21 |
| 6,285,743 | B1 | 9/2001 | Kondo et al. | 378/119 |
| 6,307,913 | B1 | 10/2001 | Foster et al. | 378/34 |
| 6,317,448 | B1 | 11/2001 | Das et al. | 372/32 |
| 6,377,651 | B1 | 4/2002 | Rihcardson et al. | 378/34 |
| 6,396,900 | B1 | 5/2002 | Barbee, Jr. et al. | 378/84 |
| 6,452,194 | B2 | 9/2002 | Bijkerk et al. | 250/492.2 |
| 6,452,199 | B1 | 9/2002 | Partlo et al. | 250/504 |
| 6,493,323 | B1 | 12/2002 | Bisschops | 378/119 |
| 6,566,667 | B1 | 5/2003 | Partlo et al. | 250/504 |
| 6,566,668 | B2 * | 5/2003 | Rauch et al. | 250/504 R |
| 6,576,912 | B2 | 6/2003 | Visser et al. | 250/492.2 |
| 6,580,517 | B2 | 6/2003 | Lokai et al. | 356/519 |
| 6,586,757 | B2 | 7/2003 | Melnychuk et al. | 250/504 |
| 6,590,959 | B2 | 7/2003 | Kandaka et al. | 378/119 |
| 6,647,086 | B2 | 11/2003 | Amemiya et al. | 378/34 |
| 6,744,060 | B2 | 6/2004 | Ness et al. | 315/111.01 |
| 6,804,327 | B2 | 10/2004 | Schriever et al. | 378/119 |
| 6,815,700 | B2 | 11/2004 | Melnychuk et al. | 250/504 |
| 6,865,255 | B2 | 3/2005 | Richardson | 378/119 |
| 7,057,190 | B2 * | 6/2006 | Bakker et al. | 250/492.2 |
| 7,091,507 | B2 * | 8/2006 | Masaki et al. | 250/504 R |
| 2002/0090054 | A1 * | 7/2002 | Sogard | 378/119 |
| 2003/0068012 | A1 | 4/2003 | Ahmad et al. | 378/119 |
| 2003/0219056 | A1 | 11/2003 | Yager et al. | 372/57 |
| 2004/0184014 | A1 * | 9/2004 | Bakker et al. | 355/30 |
| 2006/0138354 | A1 * | 6/2006 | Bakker et al. | 250/492.21 |

OTHER PUBLICATIONS

Apruzese, "X-ray laser research using Z pinches," Am. Inst. of Phys. 399-403 (1994).

Bollanti et al., "Compact three electrodes excimer laser IANUS for a POPA optical system," SPIE Proc. (2206) 144-153 (1994).

Bollanti et al., "Ianus the three-electrode excimer laser," App. Phys. B (lasers & Optics) 66(4):401-406 (1998).

Braun et al., "Multi-component EUV multiplayer mirrors," Proc. SPIE, 5037:2-13 (2003).

Choi et al., "Fast pulsed hollow cathode capillary discharge device," Rev. of Sci. Instrum. 69(9):3118-3122 (1998).

Choi et al., "Temporal development of hard and soft x-ray emission from a gas-puff Z pinch," Rev. Sci. Instrum. 57(8), pp. 2162-2164 (Aug. 1986).

Eichler et al., "Phase conjugation for realizing lasers with diffraction limited beam quality and high average power," Techninische Universitat Berlin, Optisches Institut (Jun. (1998).

R. Fedosejevs et al., "Subnanosecond pulses from a KrF laser pumped $SF_6$ Brillouin amplifier", IEEE J. QE 21, 1558-1562 (1985).

Feigl et al., "Heat resistance of EUV multiplayer mirrors for long-time applications," Microelectric Engineering, 57-58:3-8 (2001).

Fomenkov et al., "Characterization of a 13.5 nm source for EUV lithography based on a dense plasma focus and lithium emission," Sematech Intl. Workshop on EUV Lithography (Oct. 1999).

Giordano et al., "Magnetic pulse compressor for prepulse discharge in spiker sustainer excitati technique for XeC1 lasers," Rev. Sci. Instrum. 65(8), pp. 2475-2481 (Aug. 1994).

Hansson et al., "Xenon liquid jet laser-plasma source for EUV lithography," Emerging Lithographic Technologies IV, Proc. of SPIE, vol. 3997:729-732 (2000).

Jahn, Physics of Electric Propulsion, McGraw-Hill Book Company, (Series in Missile and Space USA), Chap. 9, "Unsteady Electromagnetic Acceleration," p. 257 (1968).

Jiang et al., "Compact multimode pumped erbium-doped phosphate fiber amplifers," Optical Engineering, vol. 42, Issue 10, pp. 2817-2820 (Oct. 2003).

Kato, "Electrode lifetimes in a plasma focus soft x-ray source," J. Appl. Phys. (33) Pt. 1, No. 8:4742-4744 (1991).

Kato et al., "Plasma focus x-ray source for lithography," Am. Vac. Sci. Tech. B. 6(1): 195-198 (1988).

Kuwahara et al., "Short-pulse generation by saturated KrF laser amplification of a steep stokes pulse produced by two-step stimulated brillouin scattering", J. Opt. Soc. Am. B 17, 1943-1947 (2000).

Lange et al., "High gain coefficient phosphate glass fiber amplifier," NFOEC 2003, paper No. 126.

Lebert et al., "Soft x-ray emission of laser-produced plasmas using a low-debris cryogenic nitrogen target," J. App. Phys. 84(6):3419-3421 (1998).

Lebert et al., "A gas discharged based radiation source for EUV lithography," Intl. Conf. Micro and Nano-Engineering 98 (Sep. 22-24, 1998) Leuven, Belgium.

Lebert et al., "Investigation of pinch plasmas with plasma parameters promising ASE," Inst. Phys. Conf. Ser. No. 125: Section 9, pp. 411-415 (1992) Schiersee, Germany.

Lebert et al., "Comparison of laser produced and gas discharge based EUV sources for different applications," Intl. Conf. Micro- and Nano-Engineering 98 (Sep. 22-24, 1998 Leuven, Belgium.

Lee, "Production of dense plasmas in hypocycloidal pinch apparatus," The Phys. of Fluids, 20(2):3130321 (1977).

Lewis, "Status of collision-pumped x-ray lasers," Am. Inst. Phys. pp. 9-16 (1994).

Lowe, "Gas plasmas yield x-rays for lithography," Electronics, pp. 40-41 (Jan. 27, 1982).

Malmqvist et al., "Liguid-jet target for laser-plasma soft x-ray generation," Am. Inst. Phys. 67(12):4150-4153.

Mather, "Formation of a high-density deuterium plasma focus," The Physics of Fluids, 8(2), 366-377 (Feb. 1965).

Mather et al., "Stability of the dense plasma focus,". Phys. of Fluids, 12(11):2343-2347 (1969).

Matthews et al., "Plasma sources for x-ray lithography," SPIE 333, Submicron Lithography, pp. 136-139 (1982).

Mayo et al., "A magnetized coaxial source facility for the generation of energetic plasma flows," Sci. Technol. vol. 4, pp. 47-55 (1994).

Mayo et al., "Initial results on high enthalpy plasma generation in a magnetized coaxial source," Fusion Tech vol. 26:1221-1225 (1994).

Nilsen et al., "Analysis of resonantly photopumped Na-Ne x-ray laser scheme," Am. Phys. Soc. 44(7):4592-4597 (1991).

Nishioka et al., "UV saturable absorber for short-pulse KrF laser systems," Opt. Lett. 14, 692-694 (1989).

Ormet et al., "Electrostatic charging and deflection of nonconventional droplet streams formed from capillary stream breakup," Physics of Fluids, 12(9):2224-2235, (Sep. 2000).

Orme et al., "Charged molten metal droplet deposition as a direct write technology," MRS 2000 Spring Meeting, San Francisco, (Apr. 2000).

Pant et al., "Behavior of expanding laser produced plasma in a magnetic field," Physica Sripta, T75:104-111, (1998).

Partlo et al., "EUV (13.5nm) light generation using a dense plasma focus device," SPIE Proc. on Emerging Lithographic Technologies III, vol. 3676, 846-858 (Mar. 1999).

Pearlman et al., "X-ray lithography using a pulsed plasma source," J. Vac. Sci. Technol. pp. 1190-1193 (Nov./Dec. 1981).

Porter et al., "Demonstration of population inversion by resonant photopumping in a neon gas cell irradiated by a sodium Z pinch," Phys. Rev. Let., 68(6):796-799, (Feb. 1992).

Price, "X-ray microscopy using grazing incidence reflection optics," Am. Inst. Phys. pp. 189-199, (1981).

Qi et al., "Fluorescence in Mg IX emission at 48.34 Å from Mg pinch plasmas photopumped by Al XI line radiation at 48.338 Å," The Am. Phys. Soc. 47(3):2253-2263 (Mar. 1993).

Scheuer et al., "A magnetically-nozzled, quasi-steady, multimegawatt, coaxial plasma thruster," IEEE Transactions on plasma science, 22(6) (Dec. 1994).

Schiemann et al., "Efficient temporal compression of coherent nanosecond pulses in a compact SBS generator-amplifier set up," IEEE J. QE 33, 358-366 (1997).

Schriever et al., "Laser-produced lithium plasma as a narrow-band extended ultraviolet radiation source for photoelectron spectroscopy," App. Optics, 37(7):1243-1248, (Mar. 1998).

Schriever et al., "Narrowband laser produced extreme ultraviolet sources adapted to silicon/molybdenum multiplayer optics," J. of App. Phys., 83(9):4566-4571 (May 1998).

Shiloh et al., "Z pinch of a gas jet," Physical Review Lett., 40(8), pp. 515-518 (Feb. 20, 1978).

Silfvast et al., "High-power plasma discharge source at 13.5 nm and 11.4 nm for EUV lithography," SPIE, vol. 3676:272-275, (Mar. 1999).

Silfvast et al., "Lithium hydride capillary discharge creates x-ray plasma at 13.5 namometers," Laser Focus World p. 13 (Mar. 1997).

Stallings et al., "Imploding argon plasma experiments," Appl. Phys. Lett., 35(7), pp. 524-526 (Oct. 1, 1979).

Takahashi et al., "KrF laser picosecond pulse source by stimulated scattering processes," Opt. Commun. 215, 163-167 (2003).

Takahashi et al., "High-intensity short KrF laser-pulse generation by saturated amplification of truncated leading-edge pulse," Opt. Commun. 185, 431-437 (2000).

Wilhein et al., "A slit grating spectrograph for quantitative soft x-ray spectroscopy," Am. Inst. of Phys. Rev. of Sci. Instrum., 70(3):1694-1699, (Mar. 1999).

Wu et al., "The vacuum spark and spherical pinch x-ray/EUV point sources," SPIE, Conf. on Emerging Tech. III, Santa Clara, CA, vol. 3676:410-420, (Mar. 1999).

Zombeck, "Astrophysical observations with high resolution x-ray telescope," Am. Inst. of Phys. pp. 200-209 (1981).

* cited by examiner

LPP EUV DRIVE LASER INPUT SYSTEM

RELATED APPLICATIONS

The present application is related to U.S. patent application Ser. No. 11/067,099, entitled SYSTEMS FOR PROTECTING INTERNAL COMPONENTS OF AND EUV LIGHT SOURCE FROM PLASMA GENERATED DEBRIS, filed on Feb. 25, 2005, which is and co-owned by the assignee of the present application, the disclosure of which is hereby incorporated by reference.

FIELD OF THE INVENTION

The present invention related to a Laser produced plasma ("LPP") extreme ultraviolet ("EUV") drive laser beam transit system incorporating, e.g., a focusing lens, optics debris-mitigation, and a source chamber interface.

BACKGROUND OF THE INVENTION

In the above referenced patent application Ser. No. 11/067,099, there is discussed that an LPP EUV drive laser input window may consist of two windows: one for sealing, e.g., vacuum sealing, of the EUV Plasma production chamber and another one for exposure to the debris from plasma creation and that the cleaning of such debris inside the chamber may be accomplished, e.g., with a cleaning mechanism, which may incorporate, e.g., etching with a halogen-containing gas and/or by plasma etching.

SUMMARY OF THE INVENTION

A laser produced plasma ("LPP") extreme ultraviolet ("EUV") light source and method of operating same is disclosed which may comprise an EUV plasma production chamber having a chamber wall; a drive laser entrance window in the chamber wall; a drive laser entrance enclosure intermediate the entrance window and a plasma initiation site within the chamber and comprising an entrance enclosure distal end opening; at least one aperture plate intermediate the distal opening and the entrance window comprising at least one drive laser passage aperture. The at least one aperture plate may comprise at least two aperture plates comprising a first aperture plate and a second aperture plate defining an aperture plate interim space. The at least one drive laser aperture passage may comprise at least two drive laser aperture passages. The laser passage aperture may define an opening large enough to let the drive laser beam pass without attenuation and small enough to substantially reduce debris passing through the laser passage aperture in the direction of the entrance window. The apparatus and method may further comprise a purge gas within the aperture plate interim space at a pressure higher than the pressure within the chamber. The apparatus and method may further comprise at least one laser beam focusing optic intermediate a source of the laser beam and the entrance window focusing a respective laser beam to the plasma initiation site within the chamber, which may comprise at least two laser beam focusing optics intermediate a source of a respective one of at least two laser beams and the entrance window and each focusing the respective laser beam to a respective plasma initiation site within the chamber. The apparatus and method may further comprise a respective focusing optic drive element for each of the at least two laser beam focusing optics. The apparatus and method may further comprise a purge gas supply providing purge gas to the aperture plate interim space and a purge gas discharge suction withdrawing purge gas from the aperture plate interim space. The entrance passage may comprise a tapering enclosure wherein the distal end opening comprises an opening large enough to permit the at least one laser beam to pass without attenuation and small enough to substantially prevent debris from entering the entrance passage. The apparatus and method of operating same may comprise an EUV plasma production chamber having a chamber wall; a drive laser entrance window in the chamber wall; a drive laser entrance enclosure intermediate the entrance window and a plasma initiation site within the chamber and comprising an entrance enclosure distal end opening; a protective window intermediate the entrance enclosure and the entrance window. The protective window may comprise at least two protective windows selectively interposable intermediate the entrance enclosure and the entrance window. The apparatus and method may comprise an interposing mechanism selectively interposing one of the at least two protective windows intermediate the entrance enclosure and the entrance window. The apparatus and method may further comprise a protective window cleaning zone into which at least one of the at least two protective windows is selectively positioned for cleaning when not interposed between the entrance enclosure and the entrance window, and a protective window cleaning mechanism cooperatively disposed in the cleaning zone. The apparatus and method may further comprise a cleaning gas supply mechanism supplying cleaning gas to the cleaning zone. The apparatus and method may further comprise a purge gas supply mechanism providing purge gas to a plenum intermediate the protective window and the entrance window. The cleaning gas supply mechanism and the purge gas supply mechanism may comprise the same gas supply mechanism.

DETAILED DESCRIPTION OF PREFERRED EMBODIMENTS

Applicants according to aspects of an embodiment of the present invention propose an LPP EUV drive laser source chamber with a laser beam transit system interface that also facilitates debris mitigation. A means is provided to deliver the drive laser beam, e.g., in the form of one or more drive laser beams, which in the case of a plurality are also merging and independently focusing into the source chamber while facilitating debris-mitigation features.

Figure 1:
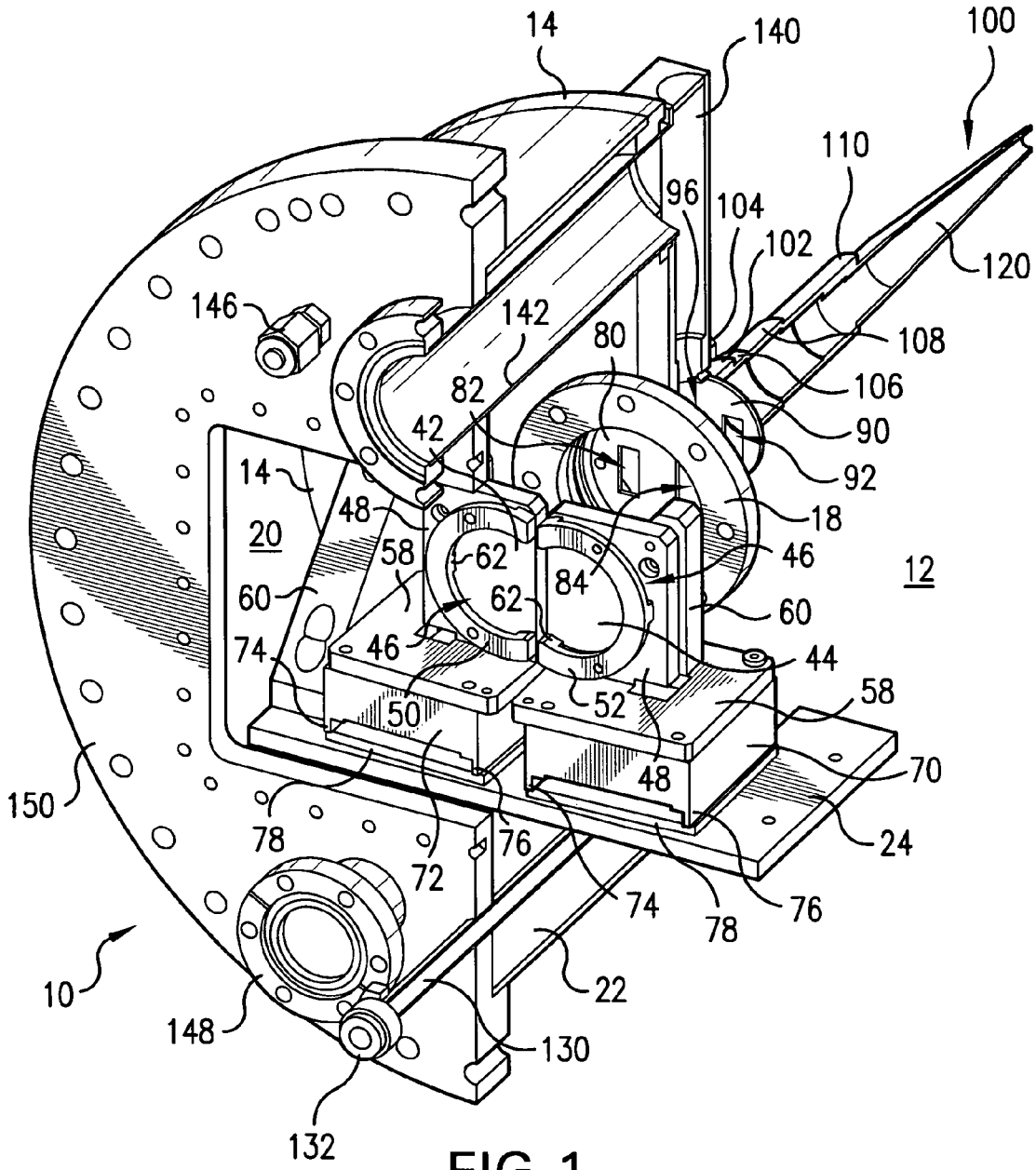
FIG. 1 shows a perspective orthogonal view partly in cross-section of a laser produced plasma ("LPP") extreme ultraviolet ("EUV") light source drive laser input window assembly with debris management according to aspects of an embodiment of the present invention.
Figure 2:
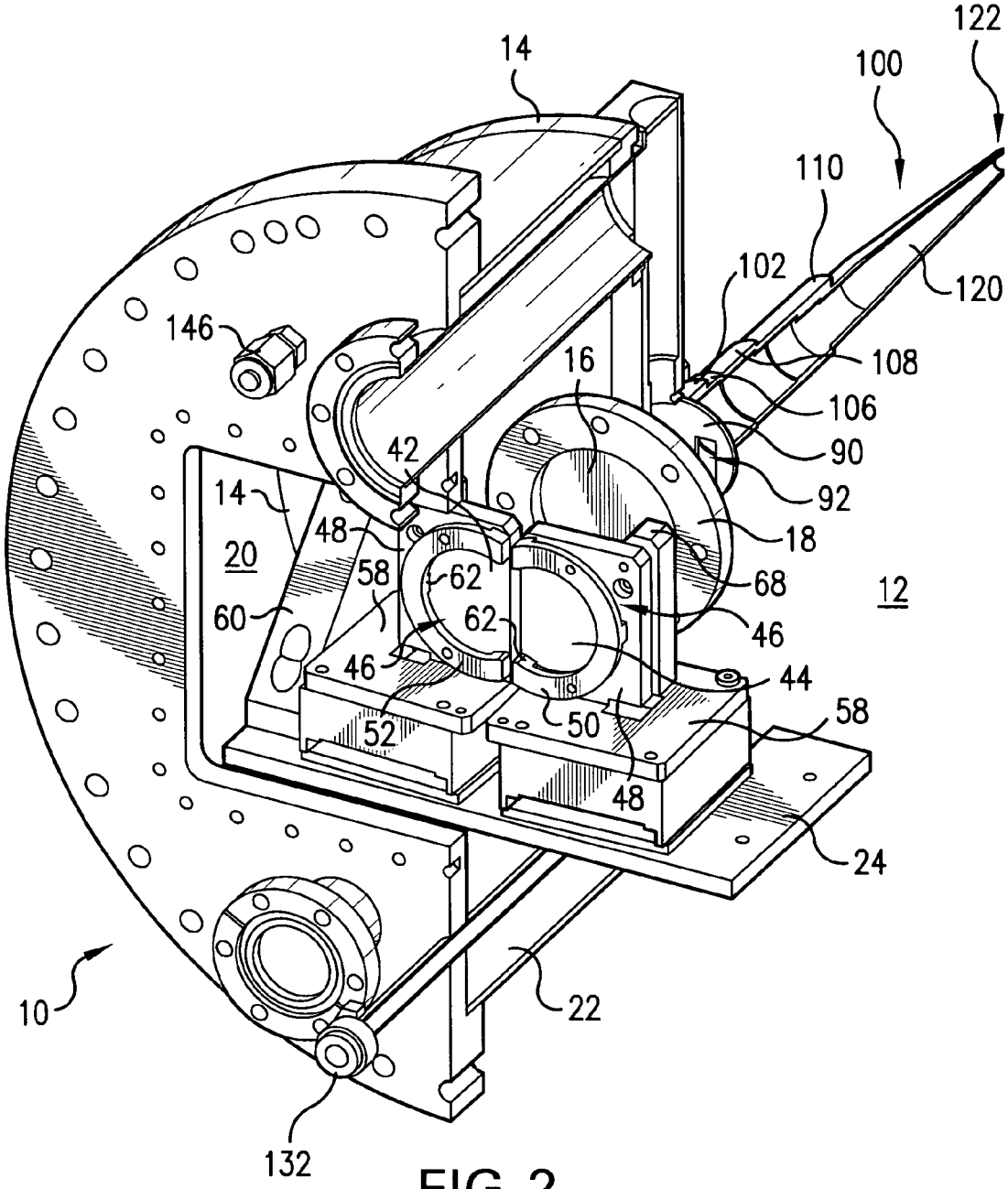
FIG. 2 shows a second perspective orthogonal view of the apparatus of FIG. 1; and, FIG. 3 shows a cross-sectional view of another embodiment of the assembly shown in FIG. 1 according to aspects of an embodiment of the present invention.

As illustrated in FIG. 1 according to aspects of an embodiment of the present invention an LPP EUV light source laser input window system 10, may comprise an LPP EUV light source plasma initiation chamber 12, having an LPP EUV light source chamber side wall 14 in which may be mounted an LPP EUV light source drive laser light input window 16. The window 16 may be sealing attached to the side wall 14 by a laser light source input window attachment flange 18. Also attached to the side wall 14 may be an laser focus assembly chamber 20, which may have a cylindrical wall 22.

Mounted inside the focus assembly chamber 20 may be, e.g., a drive laser beam delivery unit connection plate 24. Entering the focus assembly chamber may be a drive laser beam (not shown), which in some embodiments of the present invention may also include a second drive laser beam (not shown). Each of the drive laser beams may enter an optical path including, e.g., a drive laser beam focusing lens 42 and a drive laser beam focusing lens 44, each of which may be mounted on a drive laser beam focusing assembly 46 by way of being mounted in a drive laser beam focusing lens housing 48. Each lens may be held in the lens housing 46, 48 by a respective beam focusing lens mounting clamp 50, 52. The mounting clamps may each have respective mounting clamp engagement fingers 62 which hold the respective focus lens 42, 44.

The focus assembly connection plate 24 may be attached to the side wall 14 by a mounting plate bracket 60. The respective focus lens housings 46, 48 may be attached to a respective mounting plate 58 by being attached to a respective mounting yoke 68.

Each mounting plate 58 may be operatively connected to a respective driving mechanism, e.g., a respective PZT or other suitable drive unit 70, 72, depending on the need, if any, for the fine tuning, e.g., sub-micron movement, available from PZT actuation. Each drive unit may serve, e.g., to move the respective focus lens 42, 44 in the direction of the optical path to shift the focus point of the respective drive laser beam at the plasma initiation site (not shown) in the plasma initiation chamber 12. The PZT actuators 70, 72 may serve, e.g., to slide the respective lens housings 46, 48 on guide rails 74, 76 engaging guide tracks (not shown) attached to a respective translation plate 78, in order to adjust the focus of a respective drive laser beam at the plasma initiation site.

Also in the optical path of the drive laser beam(s) may be a debris management outer aperture plate 80, having according to an embodiment of the present invention a first and second debris management beam aperture 82, 84. Further along the optical path of the drive laser beam(s) 30, 32 may be a debris management inner aperture plate 90 having, e.g., a first and second debris management aperture 92 (and not shown). The apertures may be positioned and selected in size and shape to be just big enough for the respective beam(s) 30, 32 to pass through the aperture depending on the focused size of the respective beam at the point of passage through the respective apertures, i.e., the aperture(s) 82, 84 are slightly larger than the apertures 92 (and not shown). It will be understood that there may also be built into the size and shape of the aperture(s) 82, 84 and the aperture(s) 92 (and not shown) room for largest size the respective beam(s) may be at the focusing position of the respective lens housing(s) 46,48, to allow for changes in the focusing of the respective beam(s) without attenuating beam energy at the respective aperture(s) 82, 84 or the respective aperture(s) 92 (and not shown). Intermediate the aperture plates 80, 90 may be formed an intermediate beam transit passage 96 forming a gas transit plenum.

Further along the optical path(s) of the respective beam(s) may be positioned a beam debris management inner chamber enclosure assembly 100, extending into the plasma initiation chamber 12. The enclosure assembly 100, partly for ease of assembly and manufacture, may comprise according to aspects of an embodiment of the present invention a telescoping enclosure section 102, which may be attached to an inner chamber telescoping enclosure mounting flange 104, and on the opposite end also attached to another slightly smaller telescoping enclosure section 106, which may be fitted into a distal end of the section 102. This may be followed by additional respectively slightly smaller telescoped sections 108 and 110, followed still further by an elongated tapered enclosure section 120. the elongated tapered enclosure section 120 may terminate in a beam exit opening 122, or depending on the size of the focused beam(s) at that point, may have a beam(s) exit plate (not shown) with a respective beam exit aperture(s) not shown.

A purge gas inlet pipe 130 may be provided, e.g., to supply purge gas, e.g., Ar, HBr, $Br_2$, or mixtures thereof, under sufficient pressure, e.g., in the range of 0.1-10 torr to form, e.g., a stream of purge gas flowing through the gas transit plenum 96 to carry debris particles that manage to make it through either of the apertures 92 (and not shown) on the inner aperture plate 90, in order to, e.g., further reduce the amount of debris that reaches the outer aperture plate 80 apertures 82, 84 and thus further reduce the amount of debris reaching the window 16. The purge gas system may further comprise a purge gas inlet fitting 132 on the purge gas inlet line 130 and a purge gas inlet riser 134 connected between the purge gas inlet pipe 130 and the gas transit plenum 96. A purge gas inlet nozzle 136 may be connected to the riser 134 at the inlet to the plenum 96 to increase the velocity of the gas through the plenum 96. A purge gas exit riser 140 and a purge gas exit pipe 142 may serve to discharge the purge gas passing through the plenum 98 from the debris management assembly 100. Another purge gas inlet pipe (not shown) connected to a fitting 146 may serve to provide purge gas to the focus assembly chamber 20. A sealable wiring passage 148 may allow for the passage, e.g., of electrical cables through the back wall 150 of the focus assembly housing chamber 20.

It will be understood by those skilled in the art that, according to aspects of an embodiment of the present invention, the laser beam(s) entrance window can be protected via a long tubular delivery "cone" approximated by the assembly 100, with a small exit opening or a small exit aperture(s) at far end, which can serve, e.g., to limit the cross sectional area that plasma can pass through in the direction of the window 12. In addition, the length of the tube facilitates debris contacting the tube inside walls and remaining there.

Gas cross-flow between the plasma and window, e.g., through the plenum 96, which may be fed via Swagelock jointed plumbing to the plenum 96 and through to the outlet piping 140, 142. The upper end of the exit piping 142 may also be plumbed to a vacuum pump to evacuate gas and debris. The conduction path for the vacuum line is not very critical as it is desirable to have some purge gas flow down the length of the tube assembly 100, to further inhibit debris from entering and/or transiting the conical debris management assembly 100.

The aperture plates 80, 90 according to aspects of an embodiment of the present invention can further limit the path of debris to the entrance window 12 and provide some capture of gas within the confines of the plenum 96, e.g., to provide a slightly higher gas pressure in this region, which can facilitate gas flow through the assembly 100 opposite the debris flow direction. It will be further understood that in addition one might include a fluid cooled nose cone assembly 10

2, 104, 106, 108 and/or 120 (which may be necessary in any event to cool the debris management assembly 100 due to its proximity to the plasma initiation site) in order that a cooled surface is provided to which the debris can more easily stick, in essence cryo-pumping. Additionally, the aperture plates may be cooled and/or an electro magnetic field coil(s) may be provided about the nose cone 102, 104, 106, 108 and/or 120 to influence the debris path and, e.g., steer it into inside walls of a respective one of the components 102, 104, 106, 108 and/or 120.

In the process of operation of prototypes and test embodiments of the above referenced LPP EUV drive laser delivery system applicants have observed that good etching of, debris formed in an EUV creating plasma within the chamber, e.g., from the EUV radiation source material, e.g., Sn, from the surface of an optical element, e.g., a window by, e.g., HBr may be accomplished, and specifically accelerated at elevated temperature. Such a temperature may be, e.g., on the surface of the optical element and, e.g., on the order of 300-400° C. Applicants have concluded, therefore, that such optical elements, e.g., LPP EUV drive laser input (transit) windows may be cleaned in a halogen containing atmosphere, e.g., an HBr or $H_2$ atmosphere, with heating to the desired specified temperature. However, heating of such optical elements, e.g., the laser transit window which is placed in optical path of the EUV drive laser beam may be complicated for several reasons. For example, one manner of such heating, i.e., thermo-conductive heating from the side surface of the optical element, e.g., the drive laser transit window, e.g., can create a temperature gradient along the radius and thereby, e.g., distort the drive laser beam focus, e.g., which can cause, e.g., a loss of conversion energy, because, the drive laser beam is not properly focused at the target at the plasma initiation site within the chamber. Such distortion may be very difficult to compensate. Radiation heating from the front/rear surface, e.g., may be limited by the laser beam solid angle. Therefore, according to aspects of an embodiment of the present invention applicants propose apparatus and methods for the increase of the lifetime of optical elements, e.g., LPP EUV drive laser input transit window.

According to aspects of an embodiment of the present invention applicants propose to provide a solution to, e.g., the above noted exemplary problems with, e.g., the protection of and cleaning of previously proposed LPP EUV optical element, e.g., LPP drive laser beam transit systems. Applicants propose, e.g., the separation of the heating zone from the laser beam zone, as shown, schematically and by way of example, in FIG. 3.

Figure 3:
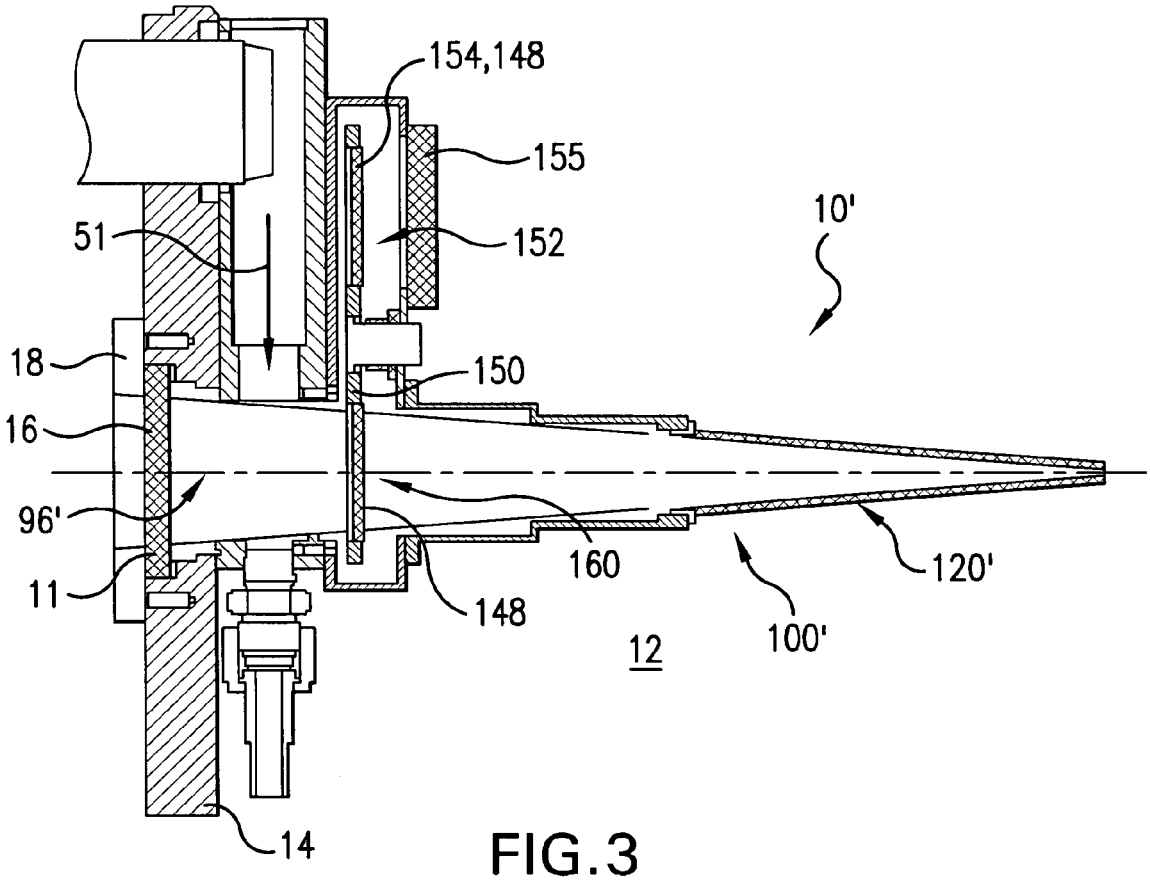

As shown in FIG. 3, an LPP EUV light source laser input window system 10' may comprise, e.g., an LPP EUV light source plasma initiation chamber 12, within which the LPP EUV light source laser input/transit window system 10' may be mounted, e.g., to an LPP EUV light source chamber side wall 14, and contain an LPP EUV light source drive laser light input window 16.

A protective window 148, which may be, e.g., is exposed to plasma formation debris, e.g., Sn debris from plasma, for certain number of pulses (e.g., 10M shots). This window 148 may, e.g., protect the vacuum containing window 16. After operation the protective window 148, which may, e.g., be mounted on a rotating wheel 150 (or turret) may be placed into a cleaning zone 152 and a clean substitute protective window 154 may thereby also be again placed into the laser beam transit zone 160. In the cleaning zone 152 the window may be, e.g., etched by an etchant specific to the debris, e.g., Sn, e.g., a halogen etchant, e.g., HBr, which may, e.g., be supplied to the cleaning cavity zone 154. A laser delivery and purge gas enclosure cone 120' may be utilized, e.g., to protect the working window 148, 154 which is currently in use from, e.g., small micro-droplets of debris, e.g., Sn atoms and Sn ions easier to accomplish, e.g., by providing only a small opening at the tapered terminal end into which the debris can enter in route to the engaged window 148, 154. Such an opening, it will be understood, may form an exit aperture sized and shaped, e.g., to essentially match the size of the desired exit drive laser beam at the point of exit from the enclosure cone 120'.

The pressure of HBr in the gas enclosure cone assembly 100' may be, e.g., on the order of 0.1-10 torr. In the cleaning zone 154 the protective window, e.g., window 148 or 154 presently selected for cleaning may be relatively uniformly heated, e.g., by a radiation heater 155, e.g., made of a conductive metal, e.g., made of molybdenum, which may be, e.g., electrically or RF heated. The rotating wheel assembly 150 may contain according to aspects of an embodiment of the present invention several protective windows, e.g., 4, rather than just the two protective windows 148, 152. The clean window 152, e.g., rotated into the working zone 160 where the LPP drive laser beam transits into the chamber may operate at a temperature substantially lower than the 300-400° C. cleaning temperature, e.g., at room temperature, e.g., in order to therefore, e.g., reduce the possible optical distortions. Etching can still occur at fairly high pressure of HBr with uniform heating of the front surface of the protective window(s) in the cleaning zone 152, which can provide the ideal conditions for efficient cleaning of the window(s) in the cleaning zone 152, e.g., from Sn debris.

Purge gas in the gas transit plenum 96' between, e.g., the input window 16 and the actively engaged protective window 148, 154 currently in place to block debris, may serve to keep the input window 16 at a desired temperature and at the same time assist in cooling the delivery cone 100' and also may flow into the cleaning zone 152 to cool the rotating wheel assembly 150 and the back side of the protective window(s) currently in the cleaning zone 152.

It will be understood by those skilled in the art that a laser produced plasma ("LPP") extreme ultraviolet ("EUV") light source and method of operating same is disclosed which may comprise an EUV plasma production chamber having a chamber wall; a drive laser entrance window in the chamber wall; a drive laser entrance enclosure intermediate the entrance window and a plasma initiation site within the chamber and comprising an entrance enclosure distal end opening; at least one aperture plate intermediate the distal opening and the entrance window comprising at least one drive laser passage aperture. The at least one aperture plate may comprise at least two aperture plates comprising a first aperture plate and a second aperture plate defining an aperture plate interim space. The at least one drive laser aperture passage may comprise at least two drive laser aperture passages. The laser passage aperture may define an opening large enough to let the drive laser beam pass without attenuation and small enough to substantially reduce debris passing through the laser passage aperture in the direction of the entrance window. within the manufacturing tolerances allowed and depending on whether or not the need for blocking debris passage through a respective aperture or the need to allow for a range of focusing of the laser beam passing through the aperture and/or loss of beam energy and/or heating of the aperture is determined to be paramount, one skilled in the art can determine what large enough means in this context, whereby a significant amount of debris is blocked such that, along with any purge gas system employed the laser entrance window is assured a reasonable operating life while the drive laser beam is not so significantly attenuated in the aperture(s) that effective production of EUV in band light at the necessary wattage, e.g., at an intermediate focus where the light, e.g., passes into a tool using the light. The purge gas within the aperture plate interim space may be at a pressure higher than the pressure within the chamber and in this manner serve to assist in blocking debris passage, by, e.g., flowing in the opposite direction of the incoming debris entering the drive laser beam entrance enclosure. The apparatus and method may further comprise at least one laser beam focusing optic intermediate a source of the laser beam and the entrance window focusing a respective laser beam to the plasma initiation site within the chamber, which may comprise at least two laser beam focusing optics intermediate a source of a respective one of at least two laser beams and the entrance window and each focusing the respective laser beam to a respective plasma initiation site within the chamber. The apparatus and method may further comprise a respective focusing optic drive element for each of the at least two laser beam focusing optics. The apparatus and method may further comprise a purge gas supply providing purge gas to the aperture plate interim space and a purge gas discharge suction withdrawing purge gas from the aperture plate interim space. The entrance passage may comprise a tapering enclosure wherein the distal end opening comprises an opening large enough to permit the at least one laser beam to pass without attenuation and small enough to substantially prevent debris from entering the entrance passage, with large enough and substantially prevent being as defined above. The apparatus and method of operating same may comprise an EUV plasma production chamber having a chamber wall; a drive laser entrance window in the chamber wall; a drive laser entrance enclosure intermediate the entrance window and a plasma initiation site within the chamber and comprising an entrance enclosure distal end opening; a protective window intermediate the entrance enclosure and the entrance window. The protective window may comprise at least two protective windows selectively interposable intermediate the entrance enclosure and the entrance window. The apparatus and method may comprise an interposing mechanism selectively interposing one of the at least two protective windows intermediate the entrance enclosure and the entrance window. The apparatus and method may further comprise a protective window cleaning zone into which at least one of the at least two protective windows is selectively positioned for cleaning when not interposed between the entrance enclosure and the entrance window, and a protective window cleaning mechanism cooperatively disposed in the cleaning zone. The apparatus and method may further comprise a cleaning gas supply mechanism supplying cleaning gas to the cleaning zone. The apparatus and method may further comprise a purge gas supply mechanism providing purge gas to a plenum intermediate the protective window and the entrance window. The cleaning gas supply mechanism and the purge gas supply mechanism may comprise the same gas supply mechanism.

It will be understood by those skilled in the art that the aspects of embodiments of the present invention disclosed above are intended to be preferred embodiments only and not to limit the disclosure of the present invention(s) in any way and particularly not to a specific preferred embodiment alone. Many changes and modification can be made to the disclosed aspects of embodiments of the disclosed invention(s) that will be understood and appreciated by those skilled in the art. The appended claims are intended in scope and meaning to cover not only the disclosed aspects of embodiments of the present invention(s) but also such equivalents and other modifications and changes that would be apparent to those skilled in the art. In additions to changes and modifications to the disclosed and claimed aspects of embodiments of the present invention(s) noted above the following could be implemented.

While the particular aspects of embodiment(s) of the LPP EUV DRIVE LASER INPUT SYSTEM described and illustrated in this patent application in the detail required to satisfy 35 U.S.C. §112 is fully capable of attaining any above-described purposes for, problems to be solved by or any other reasons for or objects of the aspects of an embodiment(s) above described, it is to be understood by those skilled in the art that it is the presently described aspects of the described embodiment(s) of the present invention are merely exemplary, illustrative and representative of the subject matter which is broadly contemplated by the present invention. The scope of the presently described and claimed aspects of embodiments fully encompasses other embodiments which may now be or may become obvious to those skilled in the art based on the teachings of the Specification. The scope of the present LPP EUV DRIVE LASER INPUT SYSTEM is solely and completely limited by only the appended claims and nothing beyond the recitations of the appended claims. Reference to an element in such claims in the singular is not intended to mean nor shall it mean in interpreting such claim element "one and only one" unless explicitly so stated, but rather "one or more". All structural and functional equivalents to any of the elements of the above-described aspects of an embodiment(s) that are known or later come to be known to those of ordinary skill in the art are expressly incorporated herein by reference and are intended to be encompassed by the present claims. Any term used in the specification and/or in the claims and expressly given a meaning in the Specification and/or claims in the present application shall have that meaning, regardless of any dictionary or other commonly used meaning for such a term. It is not intended or necessary for a device or method discussed in the Specification as any aspect of an embodiment to address each and every problem sought to be solved by the aspects of embodiments disclosed in this application, for it to be encompassed by the present claims. No element, component, or method step in the present disclosure is intended to be dedicated to the public regardless of whether the element, component, or method step is explicitly recited in the claims. No claim element in the appended claims is to be construed under the provisions of 35 U.S.C. §112, sixth paragraph, unless the element is expressly recited using the phrase "means for" or, in the case of a method claim, the element is recited as a "step" instead of an "act".

We claim:

1. A laser produced plasma extreme ultraviolet ("EUV") light source comprising:

an EUV plasma production chamber having a chamber wall;

a drive laser entrance window in the chamber wall;

a drive laser entrance enclosure intermediate the entrance window and a plasma initiation site within the chamber and comprising an entrance enclosure distal end opening;

at least one aperture plate intermediate the distal opening and the entrance window comprising at least one drive laser passage aperture.

2. The apparatus of claim 1 further comprising:

the at least one aperture plate comprising at least two aperture plates comprising a first aperture plate and a second aperture plate defining an aperture plate interim space.

3. The apparatus of claim 1 further comprising;

the at least one drive laser aperture passage comprising at least two drive laser aperture passages.

4. The apparatus of claim 2 further comprising:

the at least one drive laser aperture passage comprising at least two drive laser aperture passages in each of the at least two aperture plates.

5. The apparatus of claim 1 further comprising:

the laser passage aperture defining an opening large enough to let the drive laser beam pass without attenuation and small enough to substantially reduce debris passing through the laser passage aperture in the direction of the entrance window.

6. The apparatus of claim 2 further comprising:

the laser passage aperture defining an opening large enough to let the drive laser beam pass without attenuation and small enough to substantially reduce debris passing through the laser passage aperture in the direction of the entrance window.

7. The apparatus of claim 3 further comprising:

the laser passage aperture defining an opening large enough to let the drive laser beam pass without attenuation and small enough to substantially reduce debris passing through the laser passage aperture in the direction of the entrance window.

8. The apparatus of claim 4 further comprising:

the laser passage aperture defining an opening large enough to let the drive laser beam pass without attenuation and small enough to substantially reduce debris passing through the laser passage aperture in the direction of the entrance window.

9. The apparatus of claim 2 further comprising:

a purge gas within the aperture plate interim space at a pressure higher than the pressure within the chamber.

10. The apparatus of claim 4 further comprising:

a purge gas within the aperture plate interim space at a pressure higher than the pressure within the chamber.

11. The apparatus of claim 6 further comprising:

a purge gas within the aperture plate interim space at a pressure higher than the pressure within the chamber.

12. The apparatus of claim 8 further comprising:

a purge gas within the aperture plate interim space at a pressure higher than the pressure within the chamber.

13. The apparatus of claim 5 further comprising:

at least one laser beam focusing optic intermediate a source of the laser beam and the entrance window focusing a respective laser beam to the plasma initiation site within the chamber.

14. The apparatus of claim 6 further comprising:

at least one laser beam focusing optic intermediate a source of the laser beam and the entrance window focusing a respective laser beam to the plasma initiation site within the chamber.

15. The apparatus of claim 7 further comprising:

at least one laser beam focusing optic intermediate a source of the laser beam and the entrance window focusing a respective laser beam to the plasma initiation site within the chamber.

16. The apparatus of claim 8 further comprising:

at least one laser beam focusing optic intermediate a source of the laser beam and the entrance window focusing a respective laser beam to the plasma initiation site within the chamber.

17. The apparatus of claim 9 further comprising:

at least one laser beam focusing optic intermediate a source of the laser beam and the entrance window focusing a respective laser beam to the plasma initiation site within the chamber.

18. The apparatus of claim 10 further comprising:

at least one laser beam focusing optic intermediate a source of the laser beam and the entrance window focusing a respective laser beam to the plasma initiation site within the chamber.

19. The apparatus of claim 11 further comprising:

at least one laser beam focusing optic intermediate a source of the laser beam and the entrance window focusing a respective laser beam to the plasma initiation site within the chamber.

20. The apparatus of claim 12 further comprising:

at least one laser beam focusing optic intermediate a source of the laser beam and the entrance window focusing a respective laser beam to the plasma initiation site within the chamber.

21. The apparatus of claim 13 further comprising:

the at least one laser beam focusing element comprising at least two laser beam focusing optics intermediate a source of a respective one of at least two laser beams and the entrance window and each focusing the respective laser beam to a respective plasma initiation site within the chamber.

22. The apparatus of claim 14 further comprising:

the at least one laser beam focusing element comprising at least two laser beam focusing optics intermediate a source of a respective one of at least two laser beams and the entrance window and each focusing the respective laser beam to a respective plasma initiation site within the chamber.

23. The apparatus of claim 15 further comprising:

the at least one laser beam focusing element comprising at least two laser beam focusing optics intermediate a source of a respective one of at least two laser beams and the entrance window and each focusing the respective laser beam to a respective plasma initiation site within the chamber.

24. The apparatus of claim 16 further comprising:

the at least one laser beam focusing element comprising at least two laser beam focusing optics intermediate a source of a respective one of at least two laser beams and the entrance window and each focusing the respective laser beam to a respective plasma initiation site within the chamber.

25. The apparatus of claim 17 further comprising:

the at least one laser beam focusing element comprising at least two laser beam focusing optics intermediate a source of a respective one of at least two laser beams and the entrance window and each focusing the respective laser beam to a respective plasma initiation site within the chamber.

26. The apparatus of claim 18 further comprising:

the at least one laser beam focusing element comprising at least two laser beam focusing optics intermediate a source of a respective one of at least two laser beams and the entrance window and each focusing the respective laser beam to a respective plasma initiation site within the chamber.

27. The apparatus of claim 19 further comprising:

the at least one laser beam focusing element comprising at least two laser beam focusing optics intermediate a source of a respective one of at least two laser beams and the entrance window and each focusing the respective laser beam to a respective plasma initiation site within the chamber.

28. The apparatus of claim 20 further comprising:

the at least one laser beam focusing element comprising at least two laser beam focusing optics intermediate a source of a respective one of at least two laser beams and the entrance window and each focusing the respective laser beam to a respective plasma initiation site within the chamber.

29. The apparatus of claim 21 further comprising:

a respective focusing optic drive element for each of the at least two laser beam focusing optics.

30. The apparatus of claim 22 further comprising:

a respective focusing optic drive element for each of the at least two laser beam focusing optics.

31. The apparatus of claim 23 further comprising:
a respective focusing optic drive element for each of the at least two laser beam focusing optics.
32. The apparatus of claim 24 further comprising:
a respective focusing optic drive element for each of the at least two laser beam focusing optics.
33. The apparatus of claim 25 further comprising:
a respective focusing optic drive element for each of the at least two laser beam focusing optics.
34. The apparatus of claim 26 further comprising:
a respective focusing optic drive element for each of the at least two laser beam focusing optics.
35. The apparatus of claim 27 further comprising:
a respective focusing optic drive element for each of the at least two laser beam focusing optics.
36. The apparatus of claim 28 further comprising:
a respective focusing optic drive element for each of the at least two laser beam focusing optics.
37. The apparatus of claim 29 further comprising:
a purge gas supply providing purge gas to the aperture plate interim space and a purge gas discharge suction withdrawing purge gas from the aperture plate interim space.
38. The apparatus of claim 30 further comprising:
a purge gas supply providing purge gas to the aperture plate interim space and a purge gas discharge suction withdrawing purge gas from the aperture plate interim space.
39. The apparatus of claim 31 further comprising:
a purge gas supply providing purge gas to the aperture plate interim space and a purge gas discharge suction withdrawing purge gas from the aperture plate interim space.
40. The apparatus of claim 32 further comprising:
a purge gas supply providing purge gas to the aperture plate interim space and a purge gas discharge suction withdrawing purge gas from the aperture plate interim space.
41. The apparatus of claim 33 further comprising:
a purge gas supply providing purge gas to the aperture plate interim space and a purge gas discharge suction withdrawing purge gas from the aperture plate interim space.
42. The apparatus of claim 34 further comprising:
a purge gas supply providing purge gas to the aperture plate interim space and a purge gas discharge suction withdrawing purge gas from the aperture plate interim space.
43. The apparatus of claim 35 further comprising:
a purge gas supply providing purge gas to the aperture plate interim space and a purge gas discharge suction withdrawing purge gas from the aperture plate interim space.
44. The apparatus of claim 36 further comprising:
a purge gas supply providing purge gas to the aperture plate interim space and a purge gas discharge suction withdrawing purge gas from the aperture plate interim space.
45. The apparatus of claim 37 further comprising:
the entrance passage comprising a tapering enclosure wherein the distal end opening comprises an opening large enough to permit the at least one laser beam to pass without attenuation and small enough to substantially prevent debris from entering the entrance passage.
46. The apparatus of claim 38 further comprising:
the entrance passage comprising a tapering enclosure wherein the distal end opening comprises an opening large enough to permit the at least one laser beam to pass without attenuation and small enough to substantially prevent debris from entering the entrance passage.
47. The apparatus of claim 39 further comprising:
the entrance passage comprising a tapering enclosure wherein the distal end opening comprises an opening large enough to permit the at least one laser beam to pass without attenuation and small enough to substantially prevent debris from entering the entrance passage.
48. The apparatus of claim 40 further comprising:
the entrance passage comprising a tapering enclosure wherein the distal end opening comprises an opening large enough to permit the at least one laser beam to pass without attenuation and small enough to substantially prevent debris from entering the entrance passage.
49. The apparatus of claim 41 further comprising:
the entrance passage comprising a tapering enclosure wherein the distal end opening comprises an opening large enough to permit the at least one laser beam to pass without attenuation and small enough to substantially prevent debris from entering the entrance passage.
50. The apparatus of claim 42 further comprising:
the entrance passage comprising a tapering enclosure wherein the distal end opening comprises an opening large enough to permit the at least one laser beam to pass without attenuation and small enough to substantially prevent debris from entering the entrance passage.
51. The apparatus of claim 43 further comprising:
the entrance passage comprising a tapering enclosure wherein the distal end opening comprises an opening large enough to permit the at least one laser beam to pass without attenuation and small enough to substantially prevent debris from entering the entrance passage.
52. The apparatus of claim 44 further comprising:
the entrance passage comprising a tapering enclosure wherein the distal end opening comprises an opening large enough to permit the at least one laser beam to pass without attenuation and small enough to substantially prevent debris from entering the entrance passage.
53. A laser produced plasma extreme ultraviolet ("EUV") light source comprising:
an EUV plasma production chamber having a chamber wall;
a drive laser entrance window in the chamber wall;
a drive laser entrance enclosure intermediate the entrance window and a plasma initiation site within the chamber and comprising an entrance enclosure distal end opening;
a protective window intermediate the entrance enclosure and the entrance window.
54. The apparatus of claim 53 further comprising:
the protective window comprising at least two protective windows selectively interposable intermediate the entrance enclosure and the entrance window.
55. The apparatus of claim 53 further comprising:
an interposing mechanism selectively interposing one of the at least two protective windows intermediate the entrance enclosure and the entrance window.
56. The apparatus of claims 53 further comprising:
a protective window cleaning zone into which at least one of the at least two protective windows is selectively positioned for cleaning when not interposed between the entrance enclosure and the entrance window.
57. The apparatus of claims 54 further comprising:
a protective window cleaning zone into which at least one of the at least two protective windows is selectively positioned for cleaning when not interposed between the entrance enclosure and the entrance window.
58. The apparatus of claim 55 further comprising:
a protective window cleaning mechanism cooperatively disposed in the cleaning zone.
59. The apparatus of claim 56 further comprising:
a protective window cleaning mechanism cooperatively disposed in the cleaning zone.

60. The apparatus of claim 53 further comprising:

a cleaning gas supply mechanism supplying cleaning gas to the cleaning zone.

61. The apparatus of claim 54 further comprising:

a cleaning gas supply mechanism supplying cleaning gas to the cleaning zone.

62. The apparatus of claim 56 further comprising:

a cleaning gas supply mechanism supplying cleaning gas to the cleaning zone.

63. The apparatus of claim 57 further comprising:

a cleaning gas supply mechanism supplying cleaning gas to the cleaning zone.

64. The apparatus of claim 60 further comprising:

a purge gas supply mechanism providing purge gas to a plenum intermediate the protective window and the entrance window.

65. The apparatus of claim 61 further comprising:

a purge gas supply mechanism providing purge gas to a plenum intermediate the protective window and the entrance window.

66. The apparatus of claim 62 further comprising:

a purge gas supply mechanism providing purge gas to a plenum intermediate the protective window and the entrance window.

67. The apparatus of claim 63 further comprising:

a purge gas supply mechanism providing purge gas to a plenum intermediate the protective window and the entrance window.

68. The apparatus of claim 64 further comprising:

the cleaning gas supply mechanism and the purge gas supply mechanism are the same gas supply mechanism.

69. The apparatus of claim 65 further comprising:

the cleaning gas supply mechanism and the purge gas supply mechanism are the same gas supply mechanism.

70. The apparatus of claim 66 further comprising:

the cleaning gas supply mechanism and the purge gas supply mechanism are the same gas supply mechanism.

71. The apparatus of claim 67 further comprising:

the cleaning gas supply mechanism and the purge gas supply mechanism are the same gas supply mechanism.

* * * * *